US006230139B1

(12) United States Patent
Hara et al.

(10) Patent No.: US 6,230,139 B1
(45) Date of Patent: May 8, 2001

(54) TACTILE AND VISUAL HEARING AIDS UTILIZING SONOGRAM PATTERN RECOGNITION

(76) Inventors: Elmer H. Hara, 44 Cannington Mews, Regina, Saskatchewan (CA), S4S 0A2; Edward R. McRae, 6040 Thetis Place, Richmond, B.C. (CA), V7C 2N3

( * ) Notice: Subject to any disclaimer, the term of this patent is extended or adjusted under 35 U.S.C. 154(b) by 0 days.

(21) Appl. No.: 09/020,241

(22) Filed: Feb. 6, 1998

(51) Int. Cl.[7] ..... G10L 21/00

(52) U.S. Cl. ..... 704/276; 704/270; 434/114; 381/56

(58) Field of Search ..... 704/270, 271, 704/275, 276; 434/114, 112; 381/56

(56) References Cited

U.S. PATENT DOCUMENTS

| | | | | |
|---|---|---|---|---|
| 4,319,081 | * | 3/1982 | Martin et al. | 381/56 |
| 4,334,220 | | 6/1982 | Suzuki et al. | 340/753 |
| 4,580,133 | * | 4/1986 | Matsuoka et al. | 704/276 |
| 4,627,092 | * | 12/1986 | New | 704/276 |
| 5,165,897 | | 11/1992 | Johnson | 434/113 |
| 5,388,992 | | 2/1995 | Franklin et al. | 434/114 |

FOREIGN PATENT DOCUMENTS

| | | |
|---|---|---|
| 1075459 | 4/1980 | (CA) . |
| 1148914 | 4/1983 | (CA) . |
| 2096974 | 5/1992 | (CA) . |
| 1316347 | 4/1993 | (CA) . |
| 1320637 | 7/1993 | (CA) . |

* cited by examiner

*Primary Examiner*—David D. Knepper
(74) *Attorney, Agent, or Firm*—Pascal & Associates

(57) ABSTRACT

Presenting audio signals to a user is comprised of receiving audio signals to be presented, separating the audio signals into plural discrete frequency components extending from a low frequency to a high frequency, translating each of the frequency components into control signals, and applying the control signals to an array of tactile transducers for sensing by the user.

18 Claims, 7 Drawing Sheets

TACTILE AND VISUAL HEARING AIDS UTILIZING SONOGRAM PATTERN RECOGNITION

FIELD OF THE INVENTION

Figure 2:
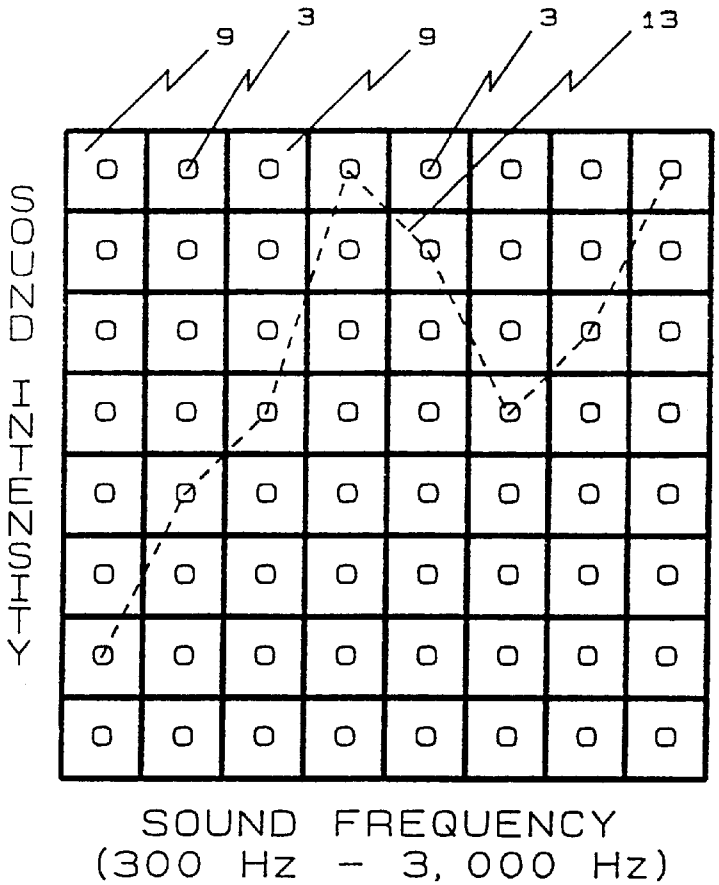

This invention relates to appliances for use as aids for the deaf.

BACKGROUND TO THE INVENTION

It is important to be able to impart hearing or the equivalent of hearing to hearing impaired people who have total hearing loss. For those persons with total hearing loss, there are no direct remedies except for electronic implants. These are invasive and do not always function in a satisfactory manner.

Reliance on lip reading and sign language limits the quality of life, and life threatening situations outside the visual field cannot be detected easily.

SUMMARY OF THE INVENTION

The present invention takes a novel approach to the provision of sound information to a user, using tactile stimulation, and using the resolving power of the brain to distinguish sounds from a tactile display which displays the sounds as a dynamic sonogram to the user.

There is anecdotal evidence that a blind person can "visualize" a rough "image" of his surroundings by tapping his cane and listening to the echoes. This is equivalent to the function of "acoustic radar" used by bats. Mapping of the human brain's magnetic activity has shown that the processing of the "acoustic radar" signal takes place in the section where visual information is processed.

Many people who have lost their sight can read Braille fairly rapidly by scanning with two or three fingers. The finger tips of a Braille reader may develop a finer mesh of nerve endings to resolve the narrowly spaced bumps on the paper. At the same time the brain develops the ability to process and recognize the patterns that the finger tips are sensing as they glide across the page.

In the present invention, this physical process is extended to hearing. A tactile sonogram display that resolves sound into frequency spectrum components and their intensities is provided to a user in real-time. A person with total hearing loss can thus develop pattern recognition skills to extract the verbal content of the sonogram.

In accordance with an embodiment of the invention, a method of presenting audio signals to a user is comprised of receiving audio signals to be presented, separating the audio signals into plural discrete frequency components extending from a low frequency to a high frequency, translating each of the frequency components into control signals, and applying the control signals to an array of tactile transducers for sensing by the user.

In accordance with another embodiment, a tactile sonogram display is comprised of a microphone for receiving audio signals, a circuit for separating the audio signals into plural discrete frequency components extending from a low frequency to a high frequency, an array of tactile transducers for applying to a tactile sensing surface of a user, a circuit for generating driving signals from the components, and a circuit for applying the driving signals to particular ones of transducers of the array so as to form a tactile sonogram.

In accordance with another embodiment, a method of presenting audio signals to a user is comprised of receiving audio signals to be presented, separating the audio signals into plural discrete frequency components extending from a low frequency to a high frequency, translating each of the frequency components into control signals, and applying the control signals to an array of light emitting devices for sensing by the user, and mounting the array on the head of a user where it can be seen by the user without substantially blocking the vision of the user.

In accordance with another embodiment, a tactile sonogram display is comprised of a microphone for receiving audio signals, a circuit for separating the audio signals into plural discrete frequency components extending from a low frequency to a high frequency, an array of light emitting devices for mounting on the head of a user where it can be seen by the user without substantially blocking vision of the user, a circuit for generating driving signals from the components, a circuit for applying the driving signals to particular ones of light emitting devices of the array so as to form a visible sonogram.

The visual sonogram display can also be reduced to a single line of light sources with the linear position of light sources representing the different frequency components.

The distribution of frequencies along the line of light sources could have a linear (i.e. equal) frequency separation or a non-linear frequency separation such as a coarser separation in the low frequency range and a finer separation in the high frequency range. The non-linear separation should enhance the ability of the brain to comprehend the sound information contained in the sonogram that is displayed.

In such a single line of light sources mentioned above, the intensity of each frequency component can be represented by the output intensity (i.e. optical output power) of each light source corresponding to a specific frequency component. The intensity scale of each light source output could be linear in response to the intensity of the sound frequency component, or non-linear (e.g. logarithmic) in response to the intensity of the sound frequency component to enhance comprehension by the brain of the sound information contained in the sonogram that is displayed.

The linear array of light sources can be affixed to the frame of eyeglasses, in a position that does not interfere significantly with the normal viewing function of the eye. The alignment of the array can either be vertical or horizontal.

In order to facilitate easy simultaneous processing by the brain of the normal viewing function and the visual sonogram display, the linear array of light sources can be positioned so that the array is imaged on to the periphery of the retina. To enhance the visual resolution of the visual sonogram display, an array of micro-lenses designed to focus the array of light sources sharply on to the retina can be placed on top of the linear array of light sources.

BRIEF INTRODUCTION TO THE DRAWINGS

Figure 1:
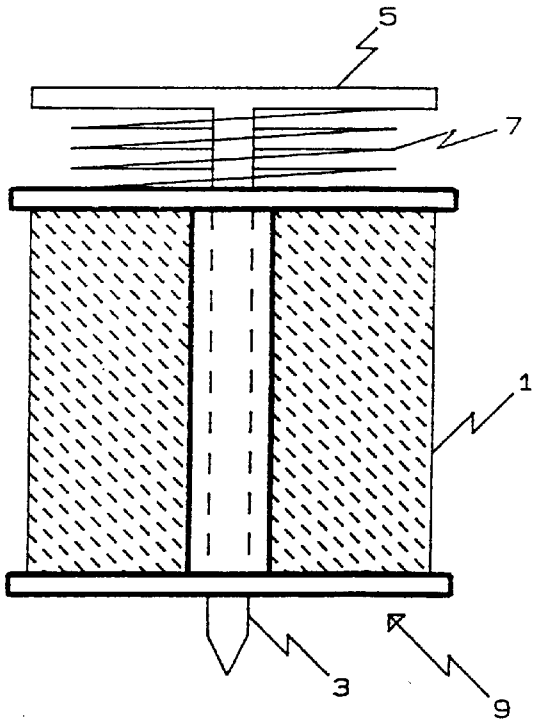
Figure 3:
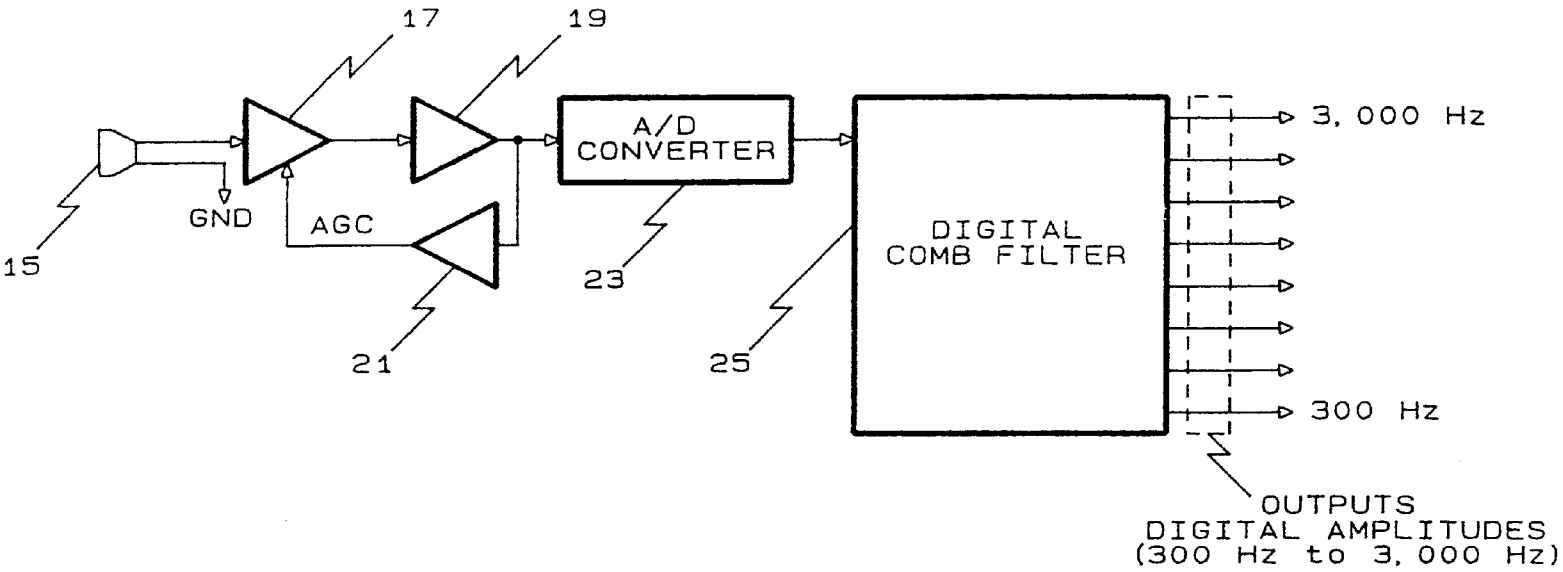
Figure 4:
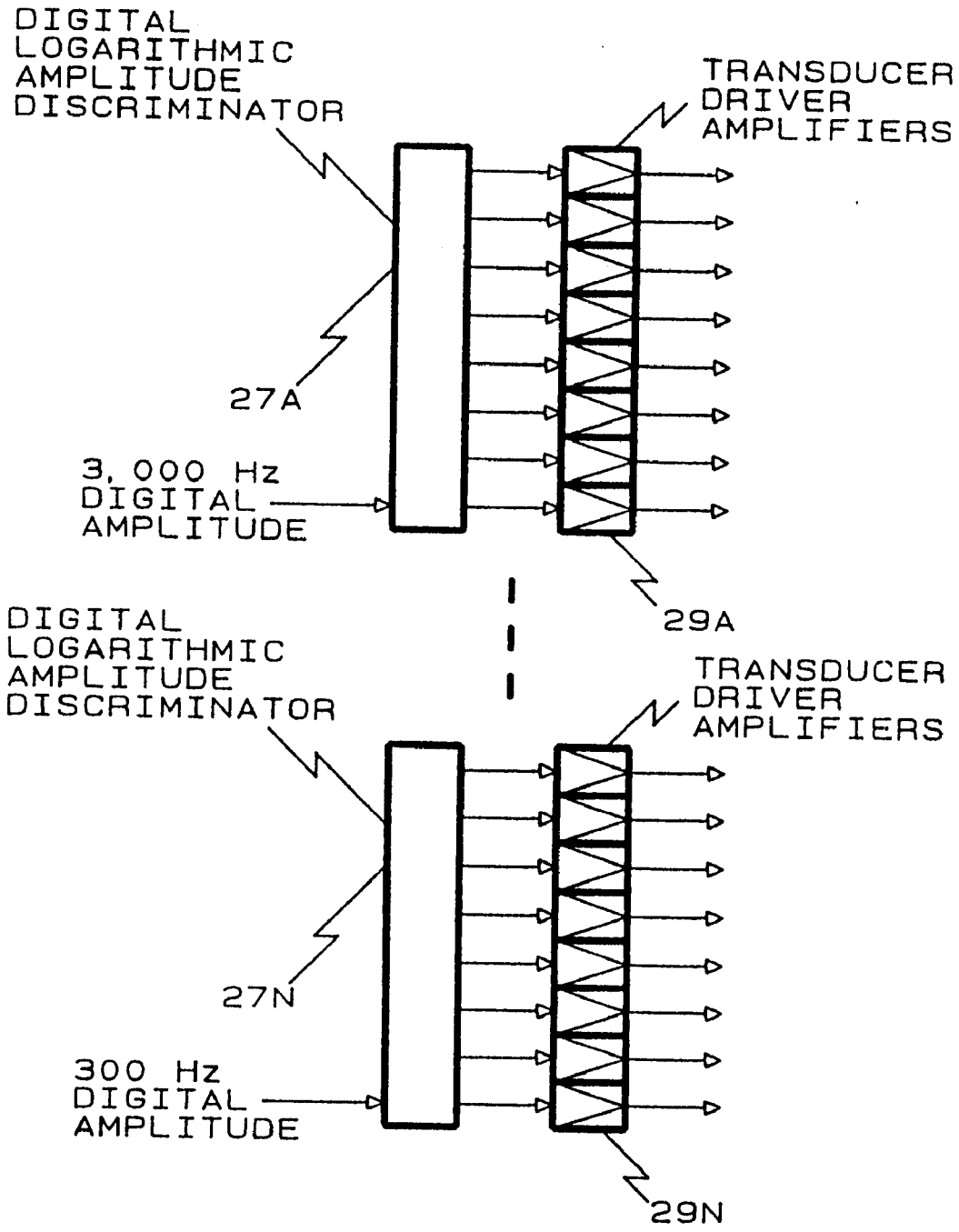
Figure 5:
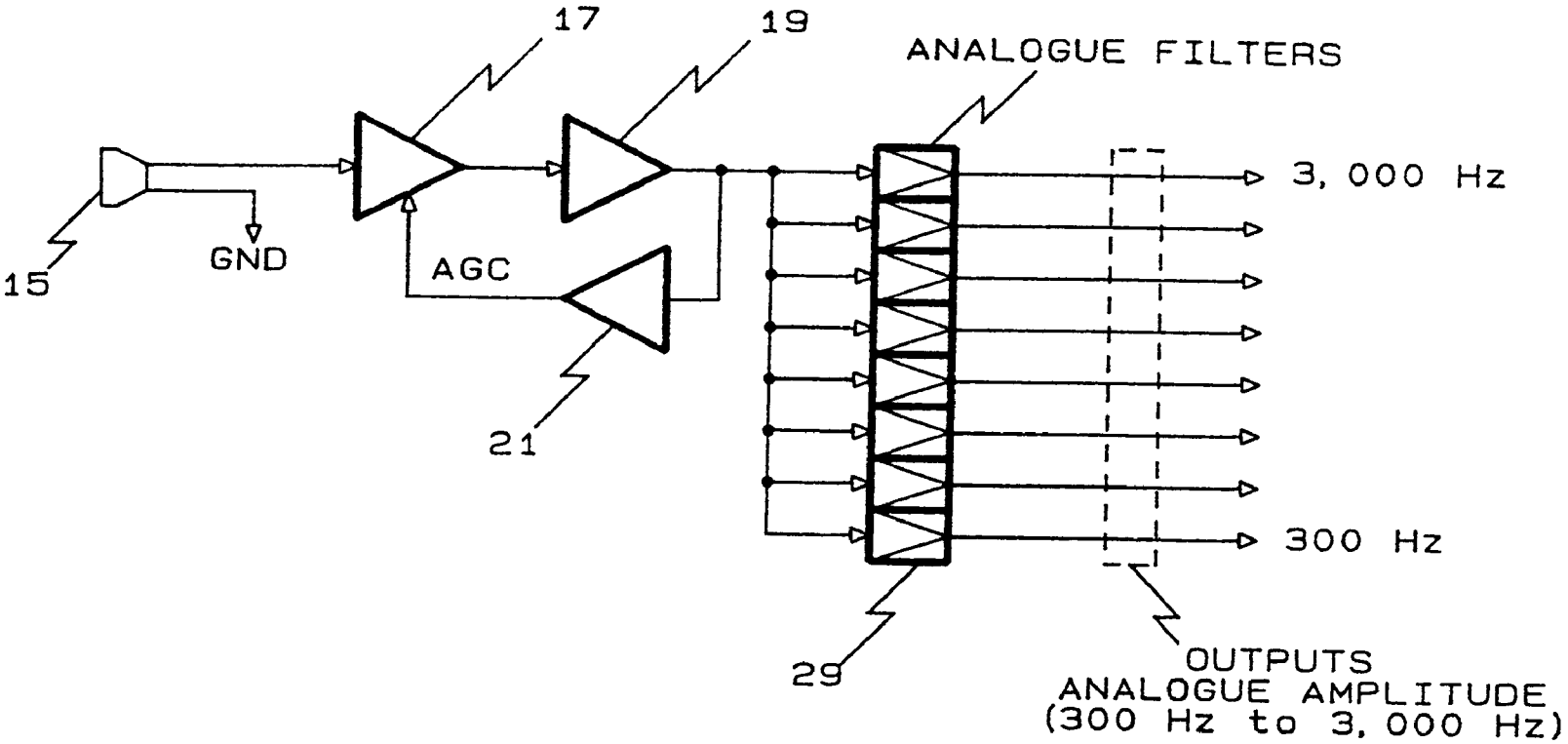
Figure 6:
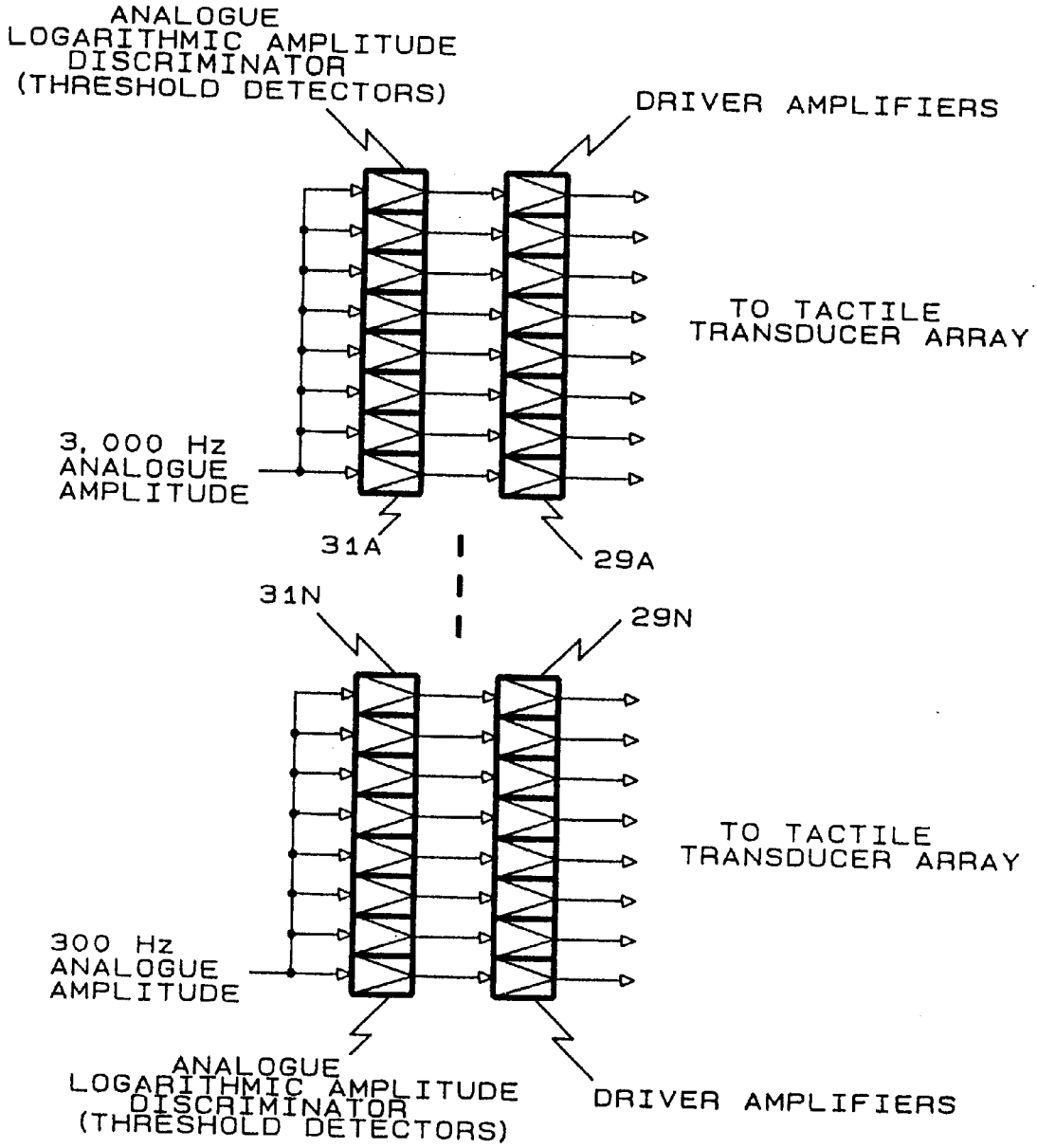
Figure 7:
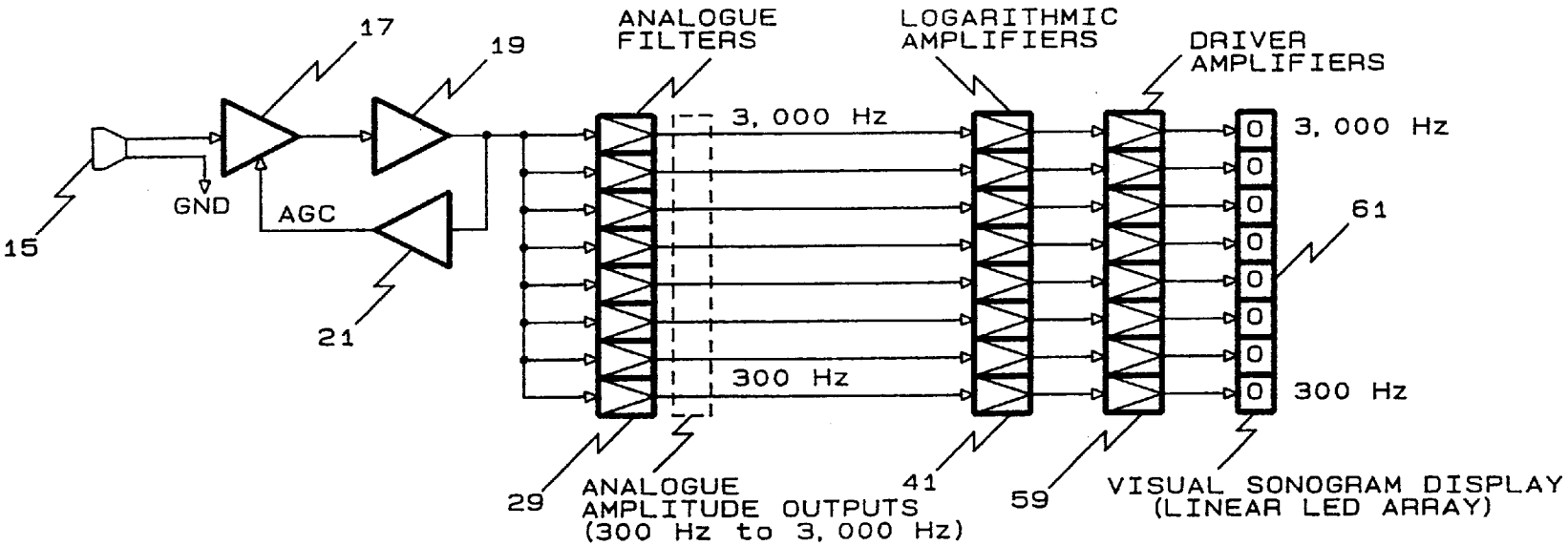
Figure 8:
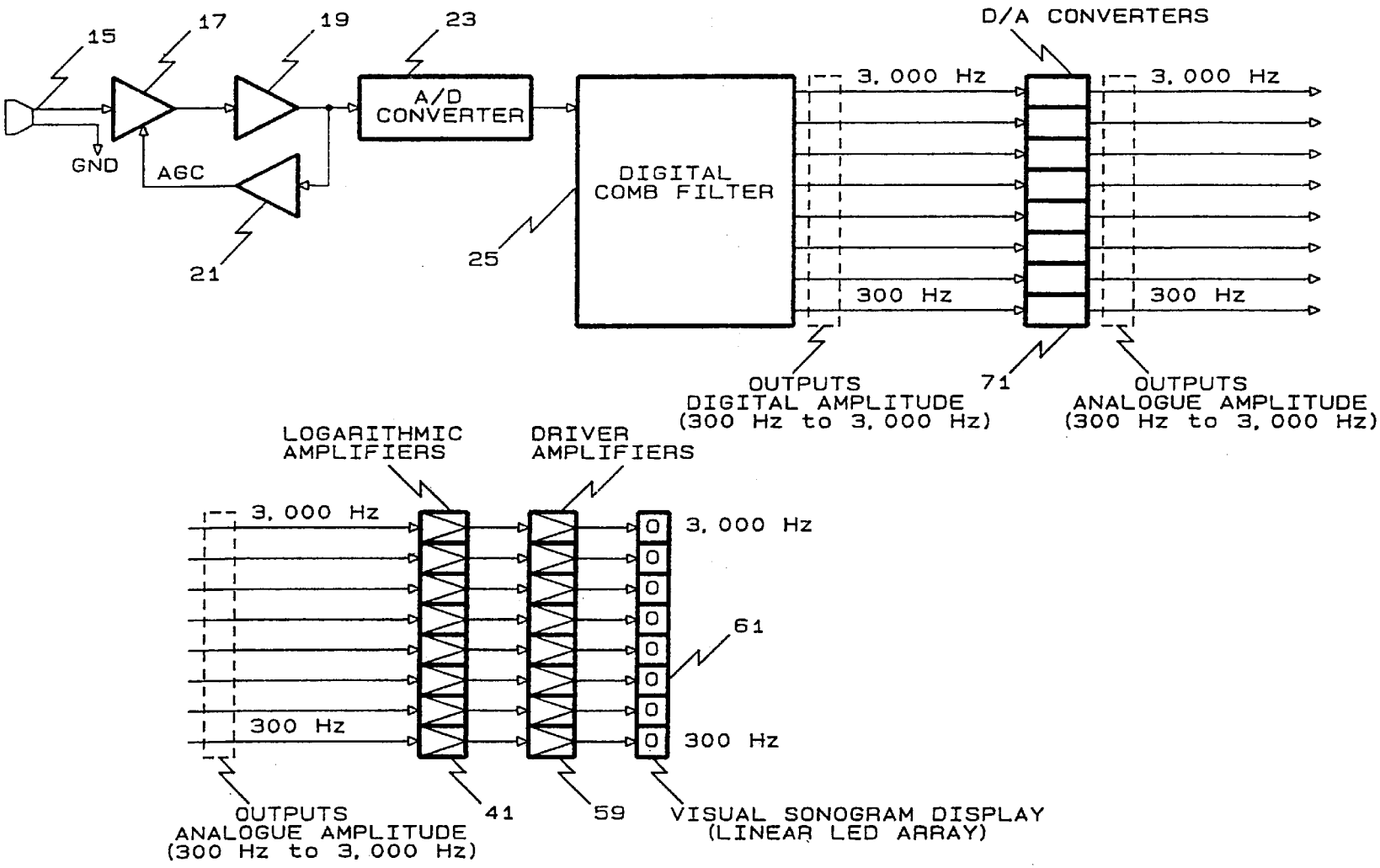

A better understanding of the invention will be obtained with reference to the detailed description below, with reference to the following drawings, in which:

FIG. 1 is a side view of an electro-tactile transducer which can be used in an array, FIG. 2 is a block diagram of an array of transducers of the kind shown in FIG. 1, FIG. 3 is a block diagram of a portion of a digital embodiment of the invention, FIG. 4 is a block diagram of a remaining portion of the embodiment of FIG. 3, FIG. 5 is a block diagram of a portion of an analog embodiment of the invention, FIG. 6 is a block diagram of a remaining portion of the embodiment of FIG. 5, FIG. 7 is a block diagram of an analog visual sonogram display, and FIG. 8 is a block diagram of a mixed analog-digital visual sonogram display.

DETAILED DESCRIPTION OF EMBODIMENTS OF THE INVENTION

Tactile displays have been previously designed, for example as described in U.S. Pat. No. 5,165,897 issued Nov. 24, 1992 and in Canadian Patent 1,320,637 issued Jul. 27, 1993. While either of those devices could be used as an element of the present invention, the details of a basic electro-tactile transducer display element which could be used in an array to form a display is shown in FIG. 1. The element is comprised of an electromagnetic winding 1 which surrounds a needle 3. The top of the needle is attached to a soft steel flange 5; a spring 7 bears against the flange from the adjacent end of the winding 1. Thus when operating current is applied to the winding 1, it causes the flange to compress the spring and the needle point to bear against the body of a user, who feels the pressure.

Plural transducers 9 are supported in an array 11 (e.g. in rows and columns), as shown in FIG. 2.

In accordance with the present invention, the columns (i.e. X-axis) of transducers are used to convey frequency information and the rows (i.e. Y-axis) of transducers are used to convey intensity information of each frequency of sound to the user. The array is driven to dynamically display in a tactile manner a sonogram of the sound. The tactile signals from the sonogram are processed in the brain of the user.

The distribution of frequencies along the rows could have a linear (i.e. equal) frequency separation or a non-linear frequency separation such as a coarser separation in the low frequency range and a finer separation in the high frequency range. The non-linear separation should enhance the ability of the brain to comprehend the sound information that is displayed.

A sonogram of an example acoustic signal to be detected by the user is shown as the imaginary dashed line 13 of FIG. 2 which is actually in the form of a dot display, although it could be a bar display or a pie chart display. In the latter case various aspects of each segment of the pie chart could be used to display different characteristics of the sound, such as each segment corresponding to a frequency, and the radial size of the segment corresponding to intensity, It is preferred that the array should have dimensions of about 40 mm to a side, although smaller or larger arrays could be used. The tactile array could be placed next to the skin on a suitably flat portion of the body such as the upper-chest area. Indeed, a pair of tactile arrays could be placed on the left and right sides of the upper-chest area. Each tactile array of the pair could be driven from separate microphones, thereby displaying the difference in arrival times of sound waves and allowing the brain to perceive the effects of stereophonic (i.e. 3-dimensional) sound.

Also, the tactile array can be arranged to be placed on a curved surface by using flexible printed circuit boards, where the curvature of said curved surface is designed to conform with the surface parts of the human body such as the upper-arm area. Each tactile array of the pair could be driven from separate microphones, thereby providing stereophonic acoustic information to the brain.

Likewise, a small tactile display with a fine mesh array could be mounted on the eyeglass frame temple piece and press against the part of the temple of a user which is devoid of hair. Indeed, a pair of arrays could be used, each mounted on respective opposite temple pieces of an eyeglass frame, and bear against opposite temples of the user. Each tactile array could be driven from a separate microphone, providing stereo acoustic tactile information to the user.

A portion of a circuit for driving the tactile display is shown in FIG. 3. A microphone 15 receives the sound to be reproduced by the display, and provides a resulting analog signal to a preamplifier 17. The preamplifier 17 provides an amplified signal to an amplifier 19. A feedback loop from the output of amplifier 19 passes a signal through an automatic gain control (AGC) amplifier 21 to an AGC input to preamplifier 17, to provide an automatic gain control.

The gain controlled signal from amplifier 19 is applied to an analog to digital (A/D) converter 23, and the resulting digital signal is applied to the input of a digital comb filter 25. The digital comb filter could be a digital signal processor (DSP) designed to perform fast fourier transform (FFT) operations equivalent to the function of a comb filter. The filter 25 provides plural digital audio frequency output signals of an acoustic signal received by the microphone 15 (e.g. components between 300 Hz and 3000 Hz). Note that, in practice, frequency component means a group of frequencies within a narrow bandwidth around a centre frequency. While ideally a full audio frequency spectrum of 30 Hz to 20 kHz is preferred to be displayed with a large number of basic elements that would form a fine mesh array, such a display would likely be too fine for the human tactile sense to resolve. Thus the typically telephone system frequency response of 300 Hz to 3000 Hz, which still allows identification of the speaker, is believed to be sufficient for typical use.

Each of the frequency components is applied to a corresponding digital amplitude discriminator 27A–27N, as shown in FIG. 4. Preferably the discriminator operates according to a logarithmic scale. The discriminator provides output signals to output ports corresponding to the amplitudes of the signal component from the comb filter applied thereto. Thus the discriminator can provide an output signal to all output ports corresponding to the maximum and smaller amplitudes of the input signal component applied, or alternatively it can provide an output signal to a single output port corresponding to the amplitude of the signal component applied.

The output signal or signals of the discriminator are applied to transducer driver amplifiers 29A–29N. The output of each driver amplifier is connected to a single transducer 9. Thus each set of driver amplifiers 20A–29N drives a column of transducers which column corresponds to a particular frequency component. The columns of transducers in the array are preferably driven in increasing frequency sequence from one edge of the array to the other, and the rows are driven with signals corresponding to the intensities of the frequency components.

Thus as sounds are received by the microphone, the tactile array is driven to display a dynamically changing tactile sonogram of the sounds. In the case that all of the driver amplifiers corresponding to amplitudes of a signal component up to the actual maximum are driven by the discriminator, a bar chart sonogram will be displayed by the array of transducers, rather than a point chart as shown in FIG. 2. In the case in which only one driver amplifier is driven by the particular discriminator which corresponds to the maximum amplitude of a frequency component, a point chart sonogram will be displayed.

FIGS. 5 and 6 illustrate an analog circuit example by which the present invention can be realized. All of the elements 15, 17, 19 and 21 are similar to corresponding elements of the embodiment of FIGS. 3 and 4. In the present case, instead of the output signal of amplifier 19 being applied to a D/A converter, it is applied to a set of analog filters 29. Each filter is a bandpass filter having characteristics to pass a separate narrow band of frequencies between 300 Hz and 3000 Hz. Thus the output signals from filters 29 represent frequency components of the signal received by the microphone 15.

Each of the output signals of the filters is applied to an analog amplitude discriminator 31A–31N, as in the previous embodiment preferably operating in a logarithmic scale. Each analog discriminator can be comprised of a group of threshold detectors, all of which in the group receive a particular frequency component. The output of the discriminator can be a group of signals signifying that the amplitude (i.e. the intensity) of the particular frequency of the input signal is at or in excess of thresholds in the corresponding group of threshold detectors. This will therefore create a bar chart form of sonogram. However, the threshold detectors can be coupled so that only the one indicating the highest amplitude outputs a signal, thus providing a point chart of the kind shown in FIG. 2.

The outputs of the discriminators 31A–31N are applied to driver amplifiers 29A–29N as in the earlier described embodiment, the outputs of which are coupled to the transducers as described above with respect to the embodiment of FIGS. 5 and 6.

It should be noted that the transducer array can be driven so as to display the sonogram in various ways, such as the three chart forms described above, or in other ways that may be determined to be particularly discernible to the user.

A pair of microphones separated by the width of a head, and a pair of the above-described circuits coupled thereto may be used to detect, process and display acoustic signals stereophonically. Alternatively, the signals from a pair of microphones separated by smaller or larger distance can be processed so as to provide stereophonic sound with appropriate separation. The displays can be mounted on eyeglass frames as described above, or can be worn on other parts of the body such as the upper arm or arms, or chest.

The invention can also be used by infants, in order to learn to distinguish the patterns of different sounds. In particular, "listening" to their own voices by means of the tactile display may help them to acquire the ability to properly learn the pattern of different sounds, by comparison and experimentation.

The tactile sonogram display will at the minimum indicate to the user that there is a sound source near the user, and if a pair of systems as described above are used to provide a stereophonic display, the user may be able to learn to identify the direction of the sound source.

It should be noted that the concepts of the present invention can be used to provide a visual display, either in conjunction with or separately from the tactile display. In place of the array of tactile transducers, or in parallel with the array of tactile transducers, an array of light emitting diodes can be operated, wherein each light emitting diode corresponds to one tactile transducer.

Such an array of light emitting diodes can be formed of a group of linear arrays, each being about 10 micron (0.01 mm) in width. The group can be about 500 micron (0.5 mm) in length, using 50 linear arrays to display the intensities of 50 frequencies between 300 Hz to 3000 Hz in 3 Hz steps, or in other steps that improve comprehension. One display or a pair of displays can be mounted on an eyeglass frame at locations such that it can be perceived by the person, but do not interfere to a significant extent with normal vision. Indeed, the visual display can be a virtual display, projected on the glass of the eyeglasses in such manner that the person sees the display transparently in his line of sight.

An example of an analog visual sonogram display system is shown in FIG. 7. All of the elements 15, 17, 19, 21 and 29 are similar to corresponding elements of the embodiment of FIG. 5. As discussed in relation to FIG. 5, the output signals from the filters 29 represent frequency components of the sound signal received by the microphone 15.

Each of the output frequency components is supplied to a corresponding logarithmic amplifier in the set of logarithmic amplifiers 41. If the response of the visual display to the sound intensity is to be linear, the set of logarithmic amplifiers 41 can be removed.

Each of the output frequency components from the set of logarithmic amplifiers 41 is supplied to a corresponding driver amplifier in the set of driver amplifiers 59. In turn each of the output frequency components from the set of driver amplifiers 59 is supplied to a corresponding light source (e.g. light emitting diode) in the linear array of light sources 61.

The embodiment of the invention described in FIG. 7 displays the variation in intensity of the frequency components of the sound received by the microphone 15, as a variation in light intensity. The numerical value of the frequency component (e.g. 2,000 Hz) is represented by the relative position of the light source within the linear array of light sources 61.

Another example of an analog visual sonogram display system is shown in FIG. 8. All of the elements 15, 17, 19, 21, 23 and 25 are similar to corresponding elements of the embodiment of FIG. 3. As discussed in relation to FIG. 3, the output signals from the digital comb filter 25 represent frequency components of the sound signal received by the microphone 15.

Each of the output frequency components from the digital comb filter 25 is supplied to a corresponding digital to analog converter (D/A) in the set of digital to analog converters 71. In turn, each of the output frequency components from the set of digital to analog converters 71 is supplied to a corresponding logarithmic amplifier in the set of logarithmic amplifiers 41. If the response of the visual display to the sound intensity is to be linear, the set logarithmic amplifiers 41 can be removed.

As discussed in relation to FIG. 7, each of the output frequency components from the set of logarithmic amplifiers 41 is supplied to a corresponding driver amplifier in the set of driver amplifiers 59. In turn, each of the output frequency components from the set of driver amplifiers 59 is supplied to a corresponding light source (e.g. light emitting diode) in the linear array of light sources 61.

Similar to the embodiment of the invention discussed in FIG. 7, the embodiment described in FIG. 8 displays the variation in intensity of the frequency components of the sound received by the microphone 15, as a variation in light intensity. The numerical value of the frequency component (e.g. 2,000 Hz) is represented by the relative position of the light source within the linear array of light sources.

The present invention thus can not only enhance the quality of life of deaf persons, but in some cases allow the avoidance of serious accidents that can arise when a sound is not heard.

A person understanding this invention may now think of alternate embodiments and enhancements using the principles described herein. All such embodiments and enhancements are considered to be within the spirit and scope of this invention as defined in the claims appended hereto.

We claim:

1. A method of presenting audio signals to a user comprising:

(a) receiving audio signals to be presented, (b) separating the audio signals into plural discrete frequency components extending from a low frequency to a high frequency, (c) translating each of the frequency components into control signals, and (d) applying the control signals to an array of tactile transducers for sensing by the user, including determining the intensity of the frequency components of the audio signals, and applying the control signals to enable particular tactile transducers in respective rows corresponding to the intensity and respective columns corresponding to frequency.

2. A method as defined in claim 1 including modulating the control signals so as to vibrate a touching element of the tactile transducers.

3. A method as defined in claim 1 in which the audio signals are separated into frequency components along a non-linear scale.

4. A method as defined in claim 1, including applying the control signals to an array of light emitting devices in which light emitting devices in columns of light emitting devices are enabled to dynamically display respective frequencies of the frequency components in rows of light emitting devices corresponding to intensities of respective frequency components.

5. A method as defined in claim 4 including fixing the array of light emitting devices to a temple of an eyeglass frame.

6. A method of presenting audio signals to a user comprising:

(a) receiving audio signals to be presented, (b) separating the audio signals into plural discrete frequency components extending from a low frequency to a high frequency, (c) translating each of the frequency components into control signals, and (d) applying the control signals to an array of tactile transducers for sensing by the user, including determining the intensity of each of the frequency components of the audio signals, and applying the control signals to particular tactile transducers wherein the tactile transducers enabled in respective columns are spaced from a first row thereof a distance dependent on the intensity of corresponding frequency components, in respective columns which correspond to the frequency of the frequency component.

7. A method as defined in claim 6 in which a single tactile transducer in each column in which a tactile transducer is to be enabled, which is most distant from the first row, is enabled, thereby forming a tactile spectrum display in a dynamic dot chart form.

8. A method of presenting audio signals to a user comprising:

(a) receiving audio signals to be presented, (b) separating the audio signals into plural discrete frequency components extending from a low frequency to a high frequency, (c) translating each of the frequency components into control signals, and (d) applying the control signals to an array of tactile transducers for sensing by the user, including determining the intensity of each of the frequency components of the audio signals, and applying the control signals to particular tactile transducers wherein the tactile transducers counting from a first row thereof are enabled in numbers corresponding to particular intensities, in columns corresponding to said frequency components, thereby forming a tactile spectrum display in a dynamic bar chart form.

9. A tactile sonogram display comprising:

(a) a microphone for receiving audio signals, (b) a circuit for separating the audio signals into plural discrete frequency components extending from a low frequency to a high frequency, (c) a circuit for generating driving signals from said components, (d) an array of tactile transducers for application to a tactile sensing surface of a user, and (e) a circuit for applying the driving signals to particular ones of transducers of the array so as to form a tactile sonogram, in which the circuit for generating driving signals is comprised of an amplitude discriminator for determining the amplitude of each of said components and for driving transducers in the array which correspond to physical distances from a base row of the array related to sound intensities at frequencies related to columns of said transducers.

10. A display as defined in claim 9 in which the amplitude discriminator has a logarithmic transfer function.

11. A display as defined in claim 10 in which the amplitude discriminator is comprised of a group of threshold detectors having successively increasing thresholds, each group of threshold detectors having an input for receiving one of the frequency components of the audio frequency and for outputting a signal to one of a group of corresponding driver amplifiers for generating a driving signal corresponding to the amplitude of the frequency component applied thereto, and a circuit for connecting each group of driver amplifiers to a column of tactile transducers of the array.

12. A display as defined in claim 9 in which the plural discrete frequency components form two groups, the groups being in different frequency bands, and further comprising a second array of tactile transducers, and a circuit for driving each array of tactile transducers.

13. A display as defined in claim 9 in which the circuit for separating is comprised of one of a group of analog filters and a digital comb filter.

14. A display as defined in claim 13 including a preamplifier connected to the microphone for receiving a signal therefrom, and an amplifier with an automatic gain control connected to an output of the preamplifier for providing a signal for application to the filter.

15. A display as defined in claim 14 in which the filter is a digital comb filter, and an analog to digital converter connected between the output of the amplifier and the digital comb filter.

16. A display as defined in claim 9 in which the array of tactile transducers includes a fastening structure for mounting on at least one temple piece of an eyeglass frame, and being of such dimension as to have a tactile display surface in contact with a substantially hairless portion of the temple of a user.

17. A pair of displays each as defined in claim 9, in which a pair of tactile transducers include fastening structures for mounting on respectively opposite temple pieces of an eyeglass frame, and being of such dimension as to have tactile display surfaces in contact with opposite substantially hairless portions of the temples of a user.

18. A display as defined in claim 9, further including an array of light emitting devices including a circuit for generating driving signals from the components for driving the light emitting devices, and a circuit for applying the driving signals to individual light emitting devices in rows of light emitting devices of columns of the light emitting devices which correspond to respective frequency components, the rows of light emitting devices corresponding to the intensity of respective frequency components.

* * * * *